United States Patent [19]

Cushman et al.

[11] 4,417,825

[45] Nov. 29, 1983

[54] PRINT DRIVE MEDIUM FOR LINE/SERIES PRINTERS

[75] Inventors: James E. Cushman, San Jose; Mario G. Plaza; Helmut K. Waibel, both of Fremont, all of Calif.

[73] Assignee: Durango Systems, Inc., San Jose, Calif.

[21] Appl. No.: 482,815

[22] Filed: Apr. 7, 1983

Related U.S. Application Data

[63] Continuation of Ser. No. 239,983, Mar. 3, 1981, abandoned.

[51] Int. Cl.[3] ..... B41J 15/00

[52] U.S. Cl. ..... 400/605; 400/611; 400/608.1; 400/608.2; 400/617; 400/616.3

[58] Field of Search ..... 400/608.1, 608.2, 616, 400/616.3, 617, 618, 619, 631, 636, 636.1, 636.3, 578, 611, 605

[56] References Cited

U.S. PATENT DOCUMENTS

| | | | |
|---|---|---|---|
| 2,390,554 | 12/1945 | Plum | 400/617 X |
| 2,881,893 | 4/1959 | Metzner | 400/616.3 |
| 3,421,612 | 1/1969 | Pitt | 400/636 X |
| 3,919,936 | 11/1975 | Barrus et al. | 400/616.3 X |
| 4,227,821 | 10/1980 | Plaza et al. | 400/616.3 |
| 4,229,113 | 10/1980 | Anderson et al. | 400/608.1 X |
| 4,234,261 | 11/1980 | Hendrischk et al. | 400/578 X |

FOREIGN PATENT DOCUMENTS

| | | | |
|---|---|---|---|
| 2716396 | 10/1978 | Fed. Rep. of Germany | 400/605 |

*Primary Examiner*—Edward M. Coven
*Attorney, Agent, or Firm*—Thomas E. Schatzel

[57] ABSTRACT

An improved print medium driving mechanism for a line or serial printer adapted for advancing either individual cut sheets or a continuous web having regularly spaced perforations preformed along its edges. The driving mechanism operates in either a friction drive mode or a spur drive mode. In friction drive mode, print medium inserted into the mechanism, is guided to a driven friction feed roller. The medium is then clamped between the feed roller and a plurality of pressure rollers. Driven by the feed roller, the medium is advanced and guided around that roller and then between immediately adjacent surfaces of a printhead and a platen. If cut sheets are being driven, they are inserted between lateral guides adjusted to the width of the sheet. Such sheets, after being advanced past the platen, contact a deflector surface of a cover which guides them into a second clamping, driven engagement in a friction feed assembly. Alternatively, perforated, preformed continuous web printing medium may be mated along its edges to spur drive members. Such printing medium engages the spur drive members both upon entering into and departing from its path around the feed roller. With the continuous web medium thus engaged, the driving mechanism is switched to spur drive mode which releases the print medium from frictional engagement at the feed roller. Further, this mode causes the continuous web to be contacted across its width by a tension bar placing it in tension along its path between the spur drive members and around the feed roller.

19 Claims, 13 Drawing Figures

PRINT DRIVE MEDIUM FOR LINE/SERIES PRINTERS

This application is a continuation, of application Ser. No. 239,983, filed Mar. 3, 1981, abandoned.

BACKGROUND OF THE INVENTION

1. Field of the Invention

The present invention relates generally to a line and serial printing apparatus and more particularly to print medium driving mechanisms adapted to advancing both individual cut sheet print medium and continuous web print medium.

2. Description of the Prior Art

U.S. Pat. No. 4,227,821, issued to Plaza et al. discloses a mechanism for line or series printers for advancing continuous web print medium having regularly spaced, preformed perforations along its edges. While such print medium is highly desirable, in many printing applications and acceptable in an even larger number of application, it is frequently commercially unacceptable. An example of an application in which continuous web print medium is commercially unacceptable is presitge level correspondence. In this category of printer application, the only commercially acceptable print medium is individual, precut sheets with the first sheet of such correspondence usually having a pre-printed letterhead. Thus, the driving mechanism disclosed in the foregoing patent, since it is adapted solely to advancing continuous web print medium, is unsuited to those applications requiring printing on individual precut sheets of print medium.

SUMMARY OF THE PRESENT INVENTION

An object of the present invention is to provide an improved print medium driving mechanism for advancing either individual cut sheets or continuous web pre-perforated print medium.

Another object is to provide a print medium driving mechanism which may be easily converted from advancing individual cut sheets to advancing continuous web pre-perforated print medium and conversely.

Another object is to provide a print medium driving mechanism which may be easily loaded with either individual cut sheets or continuous web print medium.

Briefly, this invention in preferred embodiments is an improved print medium driving mechanism for a line or serial printer. This improved driving mechanism, by means of simple adjustments, can be adapted to advance either indivdiual cut sheet print medium or continuous web print medium having regularly spaced perforations preformed along the medium's edges. Thus, the driving mechanism has a first mode of operation for advancing individual cut sheets in which only frictional forces are employed to advance the medium. Correspondingly, it also has a second mode of operation for advancing continuous web print medium in which spur drive members engage preformed perforations. Regardless of the mode of operation, the print medium enters downward into the mechanism along a path which guides it at its nadir around a friction feed roller. From this point, the path curves upward to pass through a printing station between opposing adjacent surfaces, respectively, of a printhead and platen. Upon exit from the printing station, the path continues upward to be directed toward periperal surfaces of two friction feed assemblies and two spur drive members.

In the first, friction drive mode of operation, cut sheet print medium may be inserted downward into the driving mechanism between two laterally displaced print medium lateral guides. These guides, which are a component of the friction feed assemblies, are adjusted prior to insertion of the print medium to be separated by a distance equal to its lateral width. After passing between the guides, the cut sheet is directed further downward to the point on the path at which a first set of pressure rollers are urged into contact with the periphery of the friction feed roller. With the friction feed roller stationary, further advancement of the cut sheet is barred when its leading edge reaches this point. Operation of the driving mechanism in friction drive mode requires driven rotation of the feed roller for further advancement of the cut sheet.

Upon energizing of the friction feed roller, the print medium is drawn between the adjacent surfaces of the pressure rollers and friction feed roller to be clamped therebetween. This clamping establishes a frictional engagement between the print medium and the rotating feed roller which causes the sheet to be advanced further along the path. A print medium guide pan, located beneath the feed roller and curved to conform to the roller's outer surface, conducts the advancing sheet along the path guiding it through its nadir. After the sheet passes this lowest point in the path, it encounters a second set of pressure rollers also urged into contact with the periphery of the feed roller. Upon passing this point in the path, the print medium is directed toward the printhead in the printing station.

Within the printing station, the leading edge of the print medium contacts a planar surface of the printhead. This surface, which is part of a printing ribbon guide trough of a wire matrix print head, redirects the print medium upward through a narrow gap between it and the platen. Continued advancement of the print medium effected by continued rotation of the feed roller causes the print medium's leading edge to proceed upward until it contacts a deflector surface of a cover enclosing the printhead. Contact with this deflector surface conducts the leading edge toward peripheral surfaces of the two friction feed assemblies.

In the preferred embodiment of this invention, the two mirror image friction feed assemblies are laterally displaced along and secured about a common drive shaft. These friction feed assemblies each include rotationally driven friction feed wheels into contact with which are urged feed wheel pressure rollers. It is the point of contact between these feed wheels and pressure rollers toward which the deflector directs the print medium's leading edge. Prior lateral adjustment separating the print medium lateral guides by a distance equal to the width of the print medium has positioned the paired feed wheels and pressure rollers respectively just slightly inside of the medium's lateral edges. Upon reaching these contacting elements, the print medium is again drawn between and becomes clamped by their adjacent surfaces to enter into frictional engagement with the feed wheels. These feed wheels are driven at a peripheral velocity which matches that of the driven friction feed roller. Thus, once the feed wheels frictionally engage the print medium it is withdrawn from the printing station at the same rate at which it is advanced thereinto.

An alternative embodiment of the friction feed assemblies eliminates the necessity of adjusting their lateral displacement to match the width of the print medium but imposes a restriction upon the maximum width of medium which may be advanced thereby. In this alternative embodiment, a hollow cylindrical roller, having the same diameter as the friction feed wheels, is rigidly secured therebetween enclosing the intervening length of drive shaft. Thus secured, the roller's peripheral surface bridges the gap between the peripheral surfaces of the friction feed wheels and is rotated in unison therewith. Further, this alternative embodiment replaces the feed wheel pressure rollers with three bail pressure rollers laterally displaced along a pressure bail spanning the distance between the friction feed wheels. Thus, this alternative embodiment may be easily adapted to frictionally advance print medium having any width up to the distance between the print medium lateral guides by mere lateral positioning of the bail pressure rollers.

The print medium driving mechanism of the present invention further includes means for sensing the presence of print medium therewithin. This means for sensing the presence of print medium includes a print medium sensing arm. A first terminal end of this arm, located about the nadir of the print medium path, is urged into a ring-shaped radial trough formed in the surface of the friction feed roller. A second terminal end of this arm is rigidly secured to a pivoted, rod-shaped print medium sensing shaft. Thus, print medium guided beneath the friction feed roller displaces the arm from the trough and causes the sensing shaft to rotate. This rotation may be electronically sensed by appropriately coupling an electrical switch to the print medium sensing shaft.

Transforming the driving mechanism of the present invention to the second, spur drive, mode of operation begins with conversion of either embodiment of the friction feed assembly and with adjustment of the spur drive members. The friction feed assembly is converted by rotatably positioning either the feed wheel pressure rollers or bail pressure rollers, depending upon the particular embodiment, about the drive shaft into a position beneath the friction feed wheels. Disposed in this location, these pressure rollers and their associated mechanisms lie entirely outside of the print medium path. Further, the friction feed assembly is constructed so this positioning of the pressure rollers causes withdrawal of the print medium lateral guides from the print medium path. With the guides thus retracted, print medium having a width greater than the distance between the lateral guides may be inserted into the driving mechanism. After the friction feed assemblies have been converted, the spur drive members are adjusted laterally to mate with the preformed perforations in the continuous web print medium. Since the spur drive members are secured about and are driven by the same shaft as the friction feed assemblies, this adjustment must maintain those members respectively laterally displaced outward along that shaft's length from the assemblies.

After the spur drive members have been adjusted laterally, the leading edge of the print medium is inserted into the drive mechanism as with the friction drive mode of operation. Thus inserted, the feed roller is energized and advances the print medium therearound, through the printing station and thence upward toward the spur drive members and intermediate friction feed assembly. With the continuous web print medium thus positioned, its preformed perforations are then mated with the spurs of these members in accordance with the teachings of U.S. Pat. No. 4,227,821 issued to Plaza et al. Thus, these spurs engage the perforations both upon the print medium's entry to and exit from its path. Lastly, an actuator lever, located at one lateral end of the print mechanism, is moved from its friction drive position to its spur drive position. Movement of this lever allows both sets of pressure rollers, previously urged toward the friction feed roller, to lower away therefrom thereby releasing the print medium from frictional engagement therewith. Further, this movement of the actuator lever releases a spring loaded tension bar previously held to one side of the print medium path. Thus released, the bar is urged into the print medium path wherein it contacts the continuous web across its width. This contact places that web in tension along its path between the spur drive members and around the feed roller.

An advantage of the print medium driving mechanism of the present invention is that it may be employed to advance either individual cut sheets of print medium or continuous web pre-perforated print medium.

Another advantage is that this driving mechanism may be easily converted from advancing individual cut sheet print medium to advancing continuous web pre-perforated print medium and conversely.

Another advantage is that this driving mechanism may be easily loaded with print medium in the form of either individual sheets or a continuous web.

These and other objects and advantages of the present invention will no doubt become obvious to those of ordinary skill in the art after having read the following detailed description of the preferred embodiments as illustrated in the various drawing figures.

IN THE DRAWING

DETAILED DESCRIPTION OF THE PREFERRED EMBODIMENT

Figure 1:
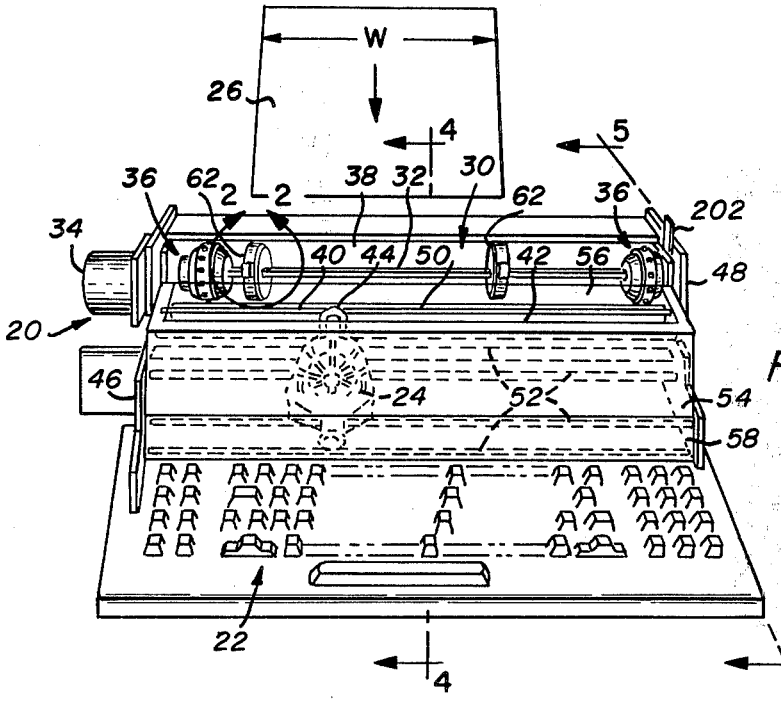
FIG. 1 is a frontal, perspective view of a high-speed printer incorporating the improved print medium driving mechanism of the present invention.

FIG. 1 depicts a high-speed printer 20 for use in a data processing system for printing information received from an information processor (not shown) or manually through a keyboard 22. The information is printed by a printhead 24 onto a print medium 26, for example, individual cut sheets of paper having a lateral width "W". In operation, it is necessary to transfer the print medium 26 past the printhead 24 in a controlled fashion such that the print medium 26 is stationary when the printing operation is taking place and then promptly advanced as each line is completed to be in position for the printing of the next line of information. The advancement of the print medium 26 must be rapid, precise and synchronized with the operation of the printhead 24.

To provide this controlled advancement of the print medium 26, the printer 20 includes an improved print medium driving mechanism referred to by the general reference character 30. The driving mechanism 30 includes a square-shaped drive shaft 32 driven about its axis by a drive step motor 34. The drive mechanism 30 also includes a pair of identical spur drive members 36 which are secured about the drive shaft 32 and are laterally displaced along its length respectively towards its left and right terminal ends. The spur drive members 36 are preferrably of the type disclosed in U.S. Pat. No. 4,227,821 issued to Plaza et al. The driving mechanism 30 further includes a J-shaped carrier support 38 (best illustrated in FIG. 4) which extends from behind the spur drive members 36 downward, across the base of the mechanism 30 and then upward to a platen 40. The platen 40 is in the form of an elongated bar having an essentially planar front face 42 positioned immediately adjacent to a ribbon guide trough 44 of the printhead 24 (best illustrated in FIG. 4). The longitudinal axis of the drive shaft 32 and the platen 40 are aligned parallel and both are supported about their respective terminal ends by a left end plate 46 and a right end plate 48. Also supported between the end plates 46 and 48 and aligned parallel to the drive shaft 32 are several printhead guide bars 52 along which the printhead 24 travels while translating laterally across the width "W" of the print medium 26. A stationary guide bar 50, aligned parallel to and located between the platen 40 and the drive shaft 32 and supported by the end plates 46 and 48, is loosely engaged by projecting arms of the spur drive members 36 to prevent their rotation with the drive shaft 32. Enclosing the printhead 24 is a hinged cover 54. Spanning the gap between the spur drive memebers 36 and the cover 54 and also hinged therefrom is a transparent deflector shield 56. Closing the gap between the base of the cover 54 and the keyboard 22 is a fixed escutcheon 58.

Figure 2:
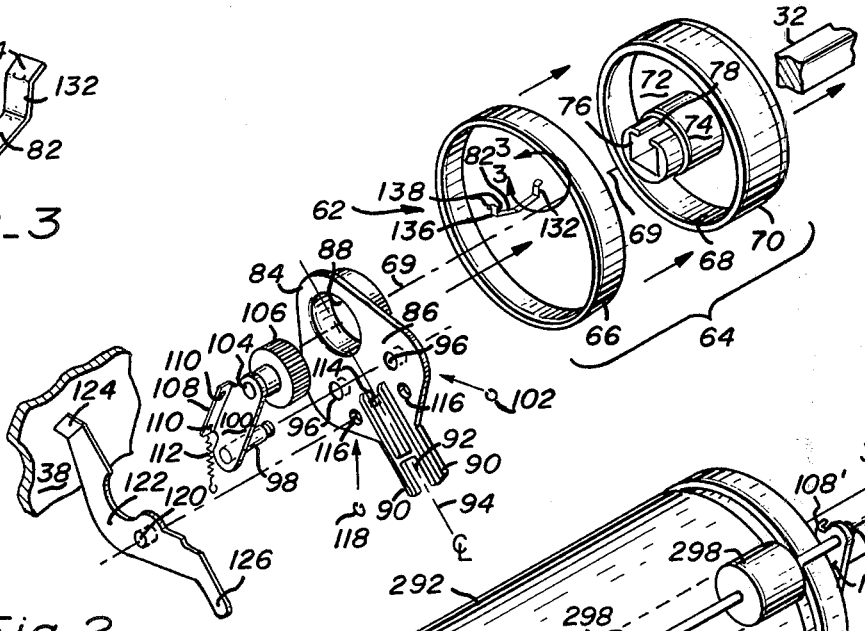
FIG. 2 is an exploded, perspective view of a friction feed assembly taken along the line 2—2 of FIG. 1.

Secured about the drive shaft 32 and located intermediate the spur drive members 36 are a pair of mirror image friction feed assemblies 62. As shown in FIG. 2, the friction feed assembly 62 includes a friction feed wheel 64 formed by securing a compliant rubber ring 66 about the periphery of a molded plastic, structural wheel 68. The wheel 68 has an axis of rotation 69 located at the center of a ring-shaped rim 70. The ring-shaped rim 70 is closed along one side by a disk-shaped wall 72. Projecting from the disk-shaped wall 72 about the axis of rotation 69 and across the width of the rim 70 is a cylindrically-shaped bearing 74. Formed through the center of the cylindrically-shaped bearing 74 about the axis of rotation 69 is a square-shaped aperture 76 for receiving the drive shaft 32. A U-shaped trough 78 is formed outward from one side surface of the square-shaped aperture 76 toward the cylindrical bearing 74. The trough 78 extends along the full length of the aperture 76 to receive a shallow, V-shaped flat spring 82.

The friction feed assembly 62 further includes a yoke 84 having a planar, diamond-shaped wall 86. Formed through and projecting outward from the diamond-shaped wall 86 near one corners is a bearing aperture 88 which mates with the bearing 74. Projecting from the diametrically opposite corner of the diamond-shaped wall 86 are a pair of parallel arms 90 which form a U-shaped trough 92 for receiving the stationary guide bar 50. Formed through the diamond-shaped wall 86 symmetrically about a center line 94 located mid-way between the arms 90 and passing through the center of the bearing aperture 88 are a pair of pressure-roller pivot apertures 96. Depending upon whether a right hand or a left hand friction feed assembly 62 is being assembled, a pivot pin 98 projecting from one terminal end of an L-shaped pressure roller arm 100 is secured within the aperture 96 by a snap ring 102. Rotatably secured about a pivot pin 104 at the other terminal end of the pressure roller arm 100 so as to be matable with the outer surface of the rubber ring 66 is a feed wheel pressure roller 106. The pivot pins 98 and 104 are identical and the pressure roller arm 100 is shaped to be a mirror image about its longitudinal mid-point so that either pin 98 or 104 may be secured within the aperture 96 while the other pin 104 or 98 receives the feed wheel pressure roller 106.

Formed through a base segment 108 of the L-shaped pressure roller arm 100 and located symmetrically about its longitudinal mid-point are a pair of spring apertures 110. With the arm 100 secured to the yoke 84, one terminal end of a coil spring 112 is secured through the spring aperture 110 closest to the pivot pin 98. The other terminal end of the coil spring 112 is then secured about a spring bracket 114 projecting outward from the diamond-shaped wall 86 and located along the center line 94 intermediate the pivot aperture 96 and the U-shaped trough 92. The spring bracket 114 is positioned so that the force which the coil spring 112 applies to the pressure roller arm 100 maintains it in one of two positions. The first position in which the pressure roller arm 100 may be thus maintained is with the pressure roller 106 in intimate contact with the rubber ring 66. The second position in which the coil spring 112 will maintain the arm 100 is with the pressure roller 106 rotated downward toward the arm 90.

Figure 3:
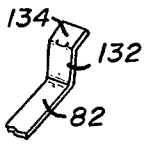
FIG. 3 is a perspective view of the first terminal end of a V-shaped flat spring taken along the line 3—3 of FIG. 2.

The diamond-shaped wall 86 of the yoke 84 also includes a pair of guide apertures 116 located symmetrically about the center line 94 and intermediate the pivot apertures 96 and the U-shaped trough 92. Secured within aperture 116 by a snap ring 118 is a pivot pin 120 of a print medium lateral guide 122. The print medium lateral guide 122 is formed with an angled tab 124 at one terminal end. The tab 124 is shaped to mate with the adjacent surface of the J-shaped carrier support 38 and to slope away from the print medium 26. A bent arm 126 projecting at the other terminal end of the lateral guide 122 is designed to be contacted by the pressure roller arm 100 when it is in its second position. Thus, when the pressure roller arm 100 contacts the bent arm 126 it causes the lateral guide 122 to rotate about the pivot pin 120 thereby displacing the angled tab 124 from the surface of the carrier support 38. The yoke 84, after the pressure roller arm 100 and the lateral guide 122 have been secured thereto, is itself secured about the bearing 74 by the flat spring 82. For this reason, as shown in FIG. 3, a first terminal 132 of the flat spring 82 is formed with a projecting tab 134, which is received by a mating aperture, not shown, formed in the hidden surface of the disk-shaped wall 72. A second terminal end 136 of the flat spring 82 is formed with angled tabs 138 so the spring 82 may further frictionally bind together the yoke 84 and the wheel 64. Further, the vertex of the V-shaped flat spring 82 presses against the drive shaft 32 to establish a frictional engagement between the walls of the aperture 76 and the received driveshaft 32. This frictional engagement resists displacement of the friction feed assembly 62 along the length of the drive shaft 32.

Figure 4:
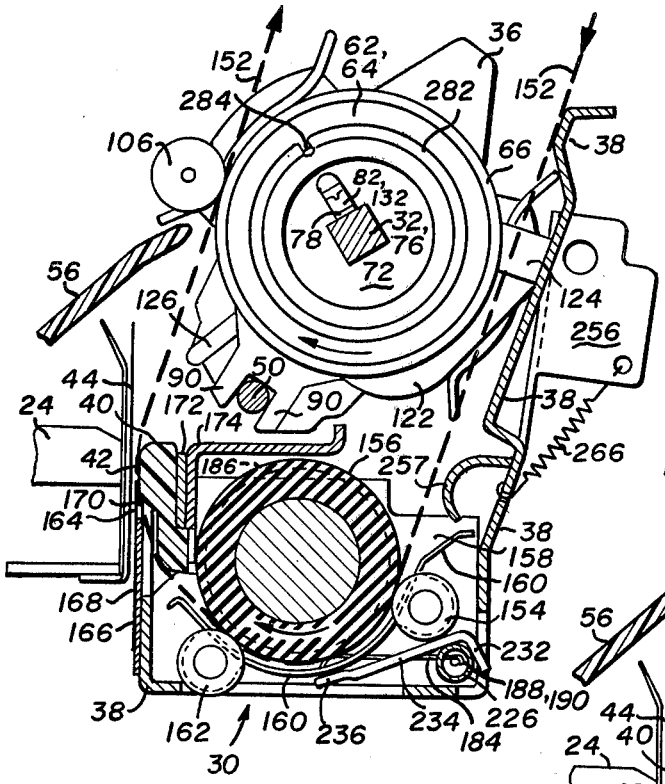
FIG. 4 is a cross-sectional view of the improved driving mechanism taken along the line 4—4 of FIG. 1 showing the print medium guide path therethrough.
Figure 4A:
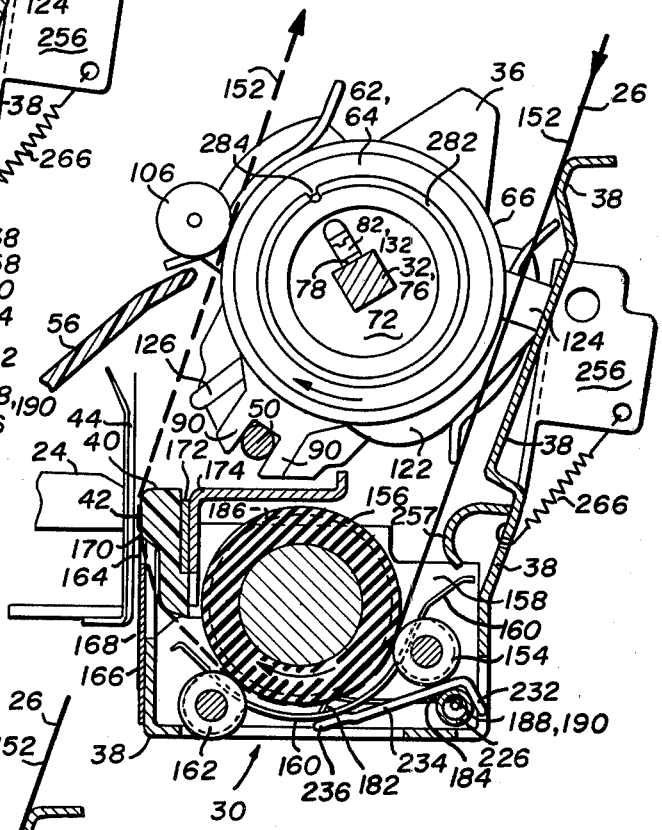
FIGS. 4A–4E show advancement of a cut sheet of print medium along the guide path of FIG. 4 with the improved driving mechanism operated in friction drive mode.

With the friction feed assembly 62 thus secured about the drive shaft 32, the improved print medium driving mechanism 30 establishes a drive path 152 within the J-shaped carrier support 38 as shown in FIG. 4. The guide path 152 begins at the top of the carrier support 38 and slopes downward between it and the rubber ring 66 of the friction feed assembly 62. The guide path 152 continues downward until it encounters a first set of pressure rollers 154 urged into contact with a friction feed roller 156. The friction feed roller 156, which extends the length of the platen 40, is rotatably supported about its terminal ends by end plates 158. Since the rollers of the first set 154 are individually much shorter than the friction feed roller 156, they are aligned coaxially along its length and are rotatably secured to a print medium guide pan 160 shaped to curve beneath the roller 156.

After passing between the friction feed roller 156 and the first set of pressure rollers 154, the guide path 152 follows the curved surface of the roller 156 to reach its nadir at a point on the roller's surface closest to the J-shaped carrier support 38. After passing this lowest point, the path 152 curves upward to encounter a second set of pressure rollers 162. As with the first set of pressure rollers 154, the second set of pressure rollers 162 are laterally displaced along the length of, and are urged into contact with the friction feed roller 156 and are also rotatably secured to the print medium guide pan 160. After passing between the second set of pressure rollers 162 and the friction feed roller 156, the guide path 152 enters a printing station 164. Within the printing station 164, the guide path 152 passes between the lower surface of the platen 40 and an upper edge of a planar print medium deflector 166 to pass between the adjacent, planar surfaces of the platen 40 and the ribbon guide trough 44. Continuing upward out of the printing station 164, the guide path 154 is directed toward the point of contact between the rubber ring 66 of the friction feed assembly 62 and its feed wheel pressure roller 106 located in its first position.

Within the printing station 164, the platen 40 is bonded along its length to its layer 172 of sound deadening material which is itself bonded along its length to a platen support bracket 174. The platen support bracket 174 is secured at its terminal ends to the end plate 158 to mechanically support the platen 40. The platen 40 is fabricated from urethane/nylon and is extruded into the shape shown. The sound deadening layer 172 is made from a rubber like material. The print medium deflector 166 comprises a thin strip of metal 168 to which is bonded an even thinner film of mylar 170 which projects upward to contact the lower surface of the platen 40.

FIG. 4A through 4E show feeding an individual cut sheet of print medium 26 along the guide path 152 through the driving mechanism 30 operated in friction drive mode. Prior to inserting the medium 26 however, the pressure roller arms 100 of the friction feed assemblies 62 are placed in their first position so the pressure rollers 106 contact the rubber rings 66. In this position, the angled tabs 124 of the print medium lateral guides 22 contact the adjacent surface of the J-shaped carrier support 38 closest to the rubber ring 66. With the pressure rollers 106 in their first position, the friction feed assemblies are then adjusted laterally along the length of the driveshaft 32 so that the distance between the print medium lateral guides 122 equals the width "W" of the print medium 26. The print medium 26 is then inserted downward along the path 152 until it reaches a point which the pressure rollers 154 contact the friction feed roller 156. Advancement of the print medium beyond this point requires clockwise rotation of the friction feed roller 156.

Figure 4B:
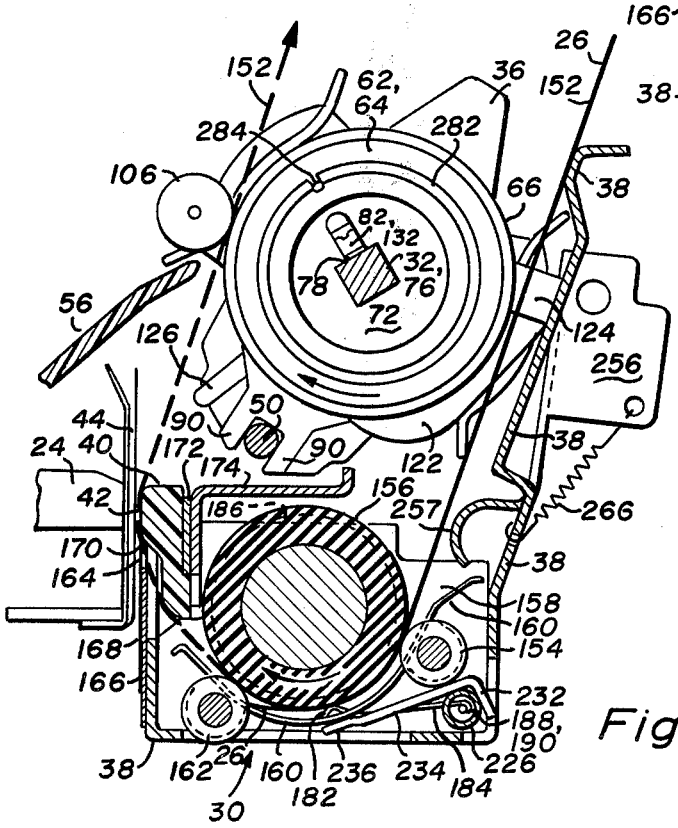

Upon clockwise rotation of the roller 156, the print medium 26 is drawn between the adjacent surfaces of the pressure rollers 154 and the friction feed roller 156 to be clamped in frictional engagement with the roller 156. Thus engaged, the leading edge of the print medium 26 is driven along the curved surface of the print medium guide pan 160 until, as shown in FIG. 4B, it reaches the second set of pressure rollers 162. As it travels along this path, the print medium 26 displaces a first terminal end 182 of a print medium sensing arm 184 out of a radial trough 186 ringing the surface of the friction feed roller 156. A second terminal end 188 of the arm 184 is secured to a first terminal end of a pivoted, rod-shaped print medium sensing shaft 190. Thus, print medium 26 at the nadir of the guide path 152 causes counter-clockwise rotation of the print medium sensing shaft 190 thereby providing a means for detecting the presence of print medium at that point in the guide path 152.

Figure 4C:
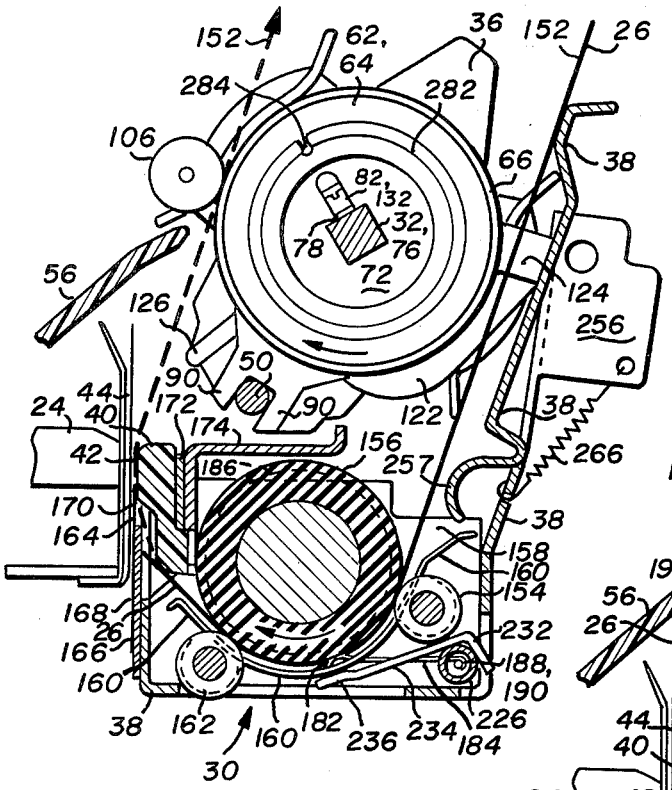
Figure 4D:
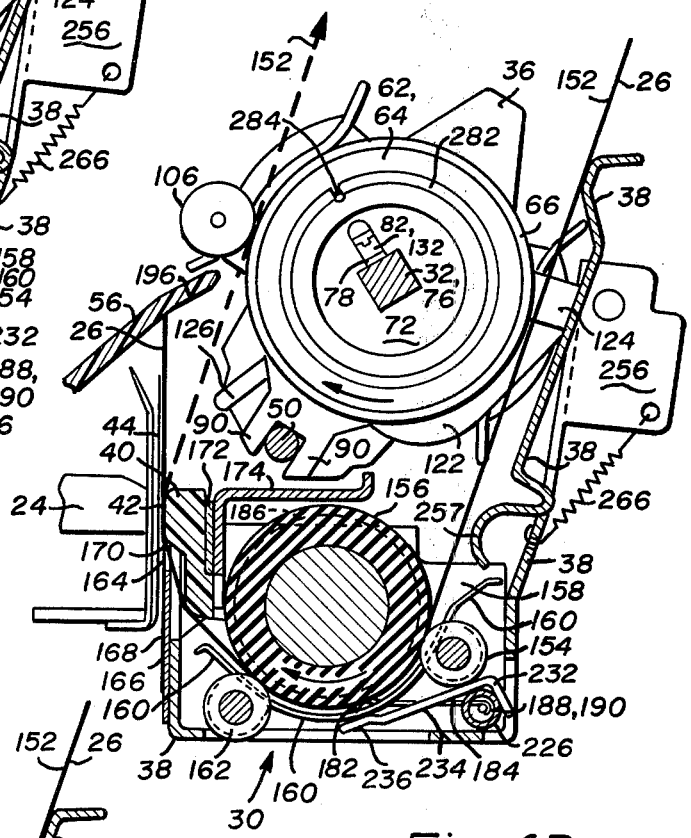
Figure 4E:
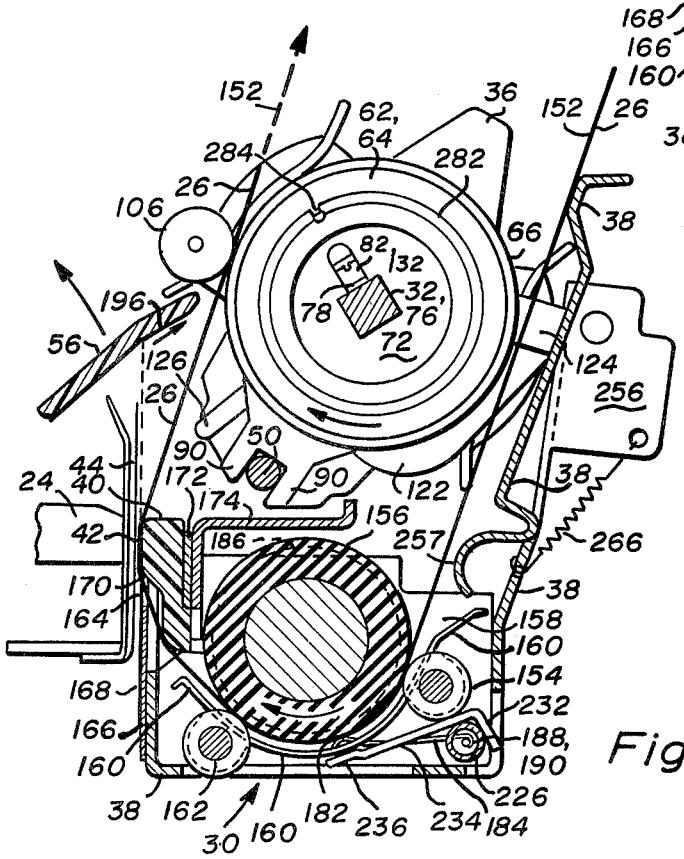

Further rotation of the roller 156, shown in FIG. 4C, places the leading edge of the print medium 26 in contact with the print medium deflector 166 in the printing station 164. Continued rotation of the friction feed roller 156, shown in FIG. 4D, then causes this edge of the print medium 26 to pass upward between the parallel adjacent surfaces of the ribbon guide trough 44 and the platen 40 to contact an angled deflection surface 196 of the transparent deflector shield 56. Additional rotation of the friction feed roller 156, shown in FIG. 4E, causes the leading edge of the print medium 26 to travel along the deflection surface 196 thereby being carried into and engaged by the pressure rollers 106 and the rubber rings 66. Simultaneous rotary motion of the drive shaft 32 and the feed wheels 64 energized by the step motor 34 is coupled to the friction feed roller 156 by a gear train, not shown, located adjacent to the left end plate 46. This train is constructed so the respective surface velocities of the feed roller 156 and the feed wheels 64 are matched. Thus, once the print medium 26 is engaged by the feed wheels 64 it is withdrawn from the printing station 164 at the same rate at which it is advanced thereinto.

The print medium driving mechanism 30 may be converted from the friction drive mode of operation just described to a spur drive mode of operation. This conversion is partially performed prior to inserting the print medium 26 along the guide path 152 by first raising the transparent deflector shield 56 and then rotating the pressure roller arms 100 downward into their second position. As previously described, this retracts the angled tabs 124 out of the guide path 152. With the angled tabs 124 thus withdrawn from the guide path 152, print medium 26 having a lateral width "W"

greater than the distance between the print medium lateral guides 122 may be inserted along the guide path 152. Further preparation of the print medium driving mechanism 30 for the insertion of continuous web print medium 26 involving the spur drive members 36 may be performed exactly as set forth in U.S. Pat. No. 4,227,821 issued to Plaza et al. The print medium 26 is then inserted along the guide path 152 and advanced exactly as set forth for FIG. 4A–4D. With the print medium 26 thus established along the guide path 152, its perforations may then be mated with the spur drive members 36 in accordance with U.S. Pat. No. 4,227,821 issued to Plaza et al. Having thus secured the continuous web of print medium 26 along the guide path 152, the print medium driving mechanism 30 is now prepared for the final act completing the conversion from friction drive mode of operation to spur drive mode of operation.

Figure 5:
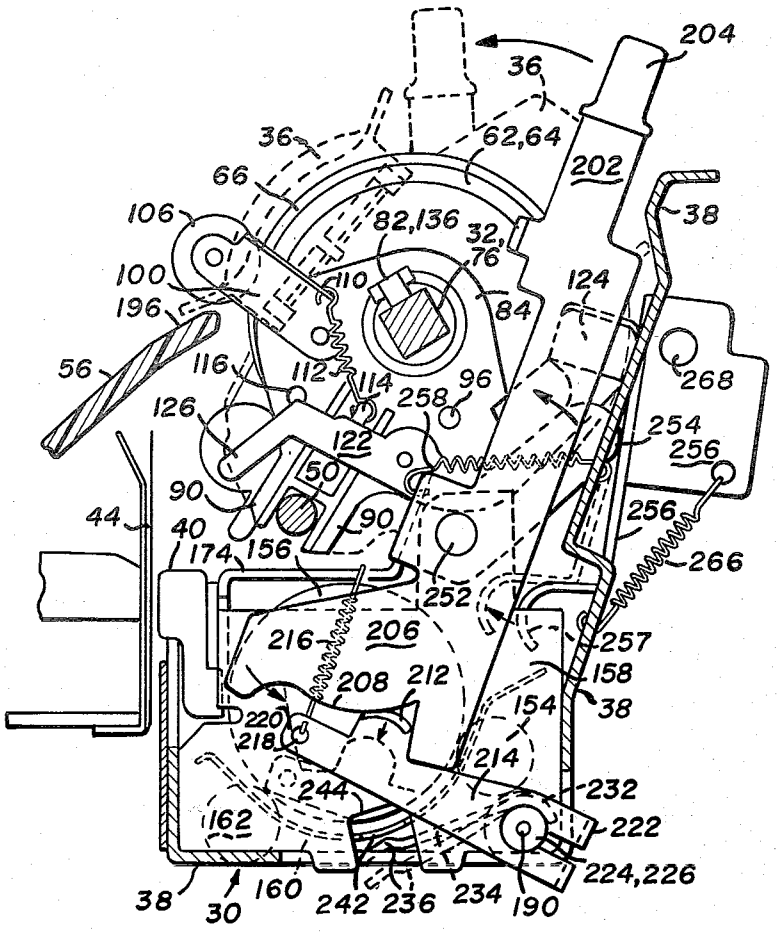
FIG. 5 is a cross-sectional view of the improved print medium driving mechanism adjusted for friction drive mode of operation taken along the line 5—5 of FIG. 1.

The final act required of this conversion is a movement of an actuator lever 202 located immediately adjacent to the left end plate 48, shown in FIG. 1. The friction drive mode state of the various elements of the print drive mechanism 30 affected by movement of the actuator lever 202 is shown in FIG. 5. Note that in FIG. 5 the visible portions of the spur drive member 36 closest to the right end plate 48 are rendered with dashed lines to permit viewing the rightmost friction feed assembly 62. Thus it is seen in FIG. 5 that the actuator lever 202 is boot-shaped having a capped terminal end 204 extending above the top of the J-shaped carrier support 38 and slopes downward to a heel and toe terminal end 206 approximately at the center of the friction feed roller 156. The terminal end 206 of the boot-shaped lever 202 is formed with a cam surface 208 along its sole between its heal and toe. With the actuator arm 202 in the sloping positon, a follower surface 212 of a friction release arm 214 is drawn upward by a coil spring 216 into the notched juncture between the cam surface 208 and the heel of the terminal end 206. To provide this force, the coil spring 216 is secured between the platen support bracket 174 and an aperture 218 formed through a first terminal end 220 of the friction release arm 214. A second terminal end 222 of the friction release arm 214 is secured about a first terminal end 224 of a friction release tube 226. The friction release tube 226 extends from the end plate 158 along the length of the friction feed roller 156 past its longitudinal mid-point. Along its length, the friction release tube 226 surrounds the print medium sensing shaft 190 which is supported so it may rotate indpendently of any rotation of the friction release tube 226.

Secured to the friction release tube 226 about the longitudinal midpoint of the roller 156 is a first terminal end 232 of a print medium guide pan arm 234. A second terminal end 236 of the arm 234 contacts the print medium guide pan 160 about its lateral nadir and its longitudinal mid-point. Thus, the force applied to the friction release arm 214 by the coil spring 216 coupled through the tube 226 and the arm 234 to the guide pan 160 urges the pressure rollers 154 and 162 toward the friction feed roller 156. Consequently, downward rotation of the first terminal end 220 of the friction release arm 214 rotating the friction release tube 226 permits the print medium guide pan 160 and the pressure rollers 154 and 162 secured thereto to lower away from the friction feed roller 156. Lateral motion of the guide pan 160 within the J-shaped trough of the carrier support 38 is prevented by means of tabs 242 projecting from the lateral ends of the print medium guide pan 160. The tabs 242 are formed to project outward through U-shaped apertures 244 formed in the end plates 158.

The actuator arm 202 is rotatably supported within the print medium driving mechanism 30 by a pin 252 passing through it near its longitudinal midpoint. About the pin 252, which is secured to and projects outward from the end plate 158, the actuator arm 202 is shaped in the form of a U-shaped trough open along the length of the pin 252. The portion of this trough immediately adjacent to the end plate 158 slopes upward to a terminal end 254 which extends through the J-shaped carrier support 38. Projecting through the carrier support 38, the terminal end 254 contacts a tension member 256 having a projecting C-shaped tension bar 257. With the terminal end 254 of the actuator arm 202 extending through the carrier support 38, the tension bar 257 is positioned close to the carrier support 38 and out of the guide path 152. A coil spring 258 passing through the U-shaped portion of the actuator lever 202 and secured between its base and the J-shaped carrier support 38 applies a force to the lever 202 which maintains it in this sloped position.

Figure 6:
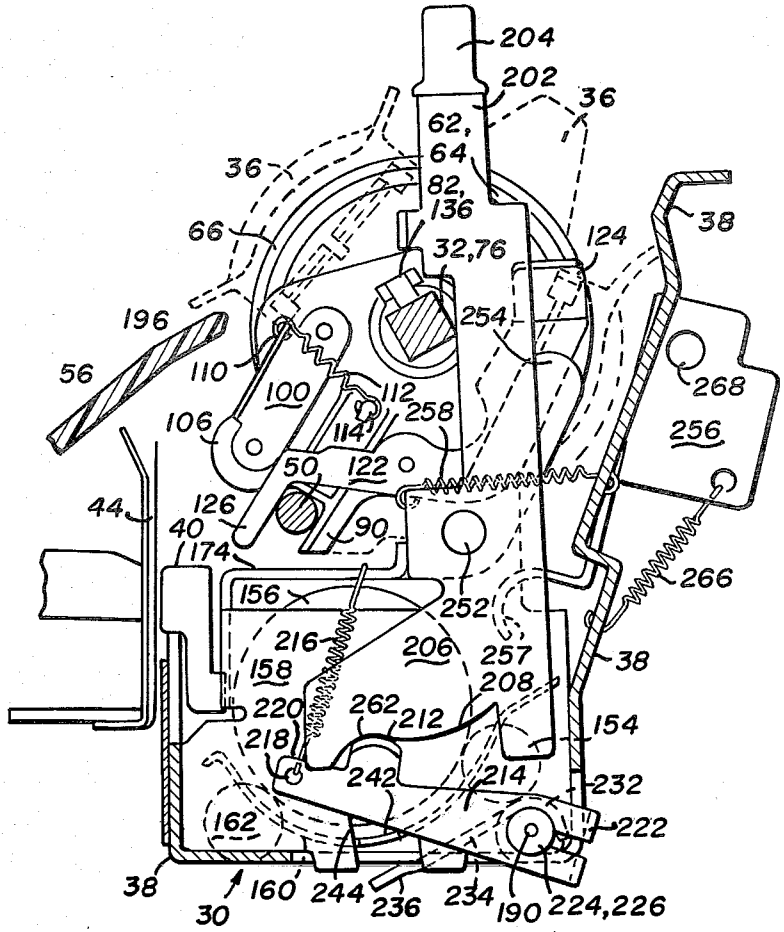
FIG. 6 is a cross-sectional view of the improved print medium driving mechanism adjusted for spur drive mode of operation taken along the line 5—5 of FIG. 1.

Counter-clockwise rotation of the sloped actuator lever 202 about the pin 252, shown with dashed lines in FIG. 5, completes the conversion to spur drive mode of operation, shown in FIG. 6. When the print medium driving mechanism 30 is in spur drive mode of operation, the actuator arm 202 is maintained in an almost vertical position. In this position, the heel of the terminal end 206 is positioned immediately adjacent to the J-shaped carrier support 38 while the toe is positioned about the center of the friction feed roller 156. The actuator arm 202 is maintained in this position despite the opposing rotary force of the coil spring 258 by a curved notch 262 formed in the cam surface 208 mating with and engaging the follower surface 212 of the friction release arm 214. Thus, when rotated downward by the actuator arm 202, the friction release arm 214 both lowers the guide pan 160 and locks the arm 202. With the actuator arm 202 locked in this position, the terminal end 254 of the U-shaped section is moved out of contact with the tension member 256.

Figure 7:
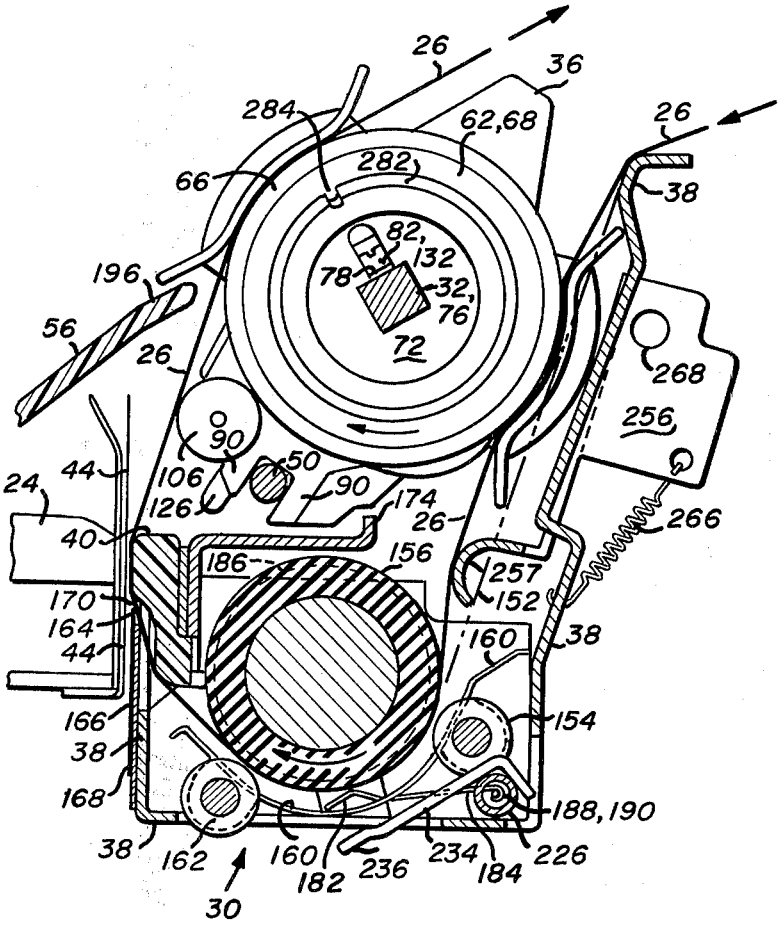
FIG. 7 is a cross-sectional view of the improved print medium driving mechanism taken along the line 4—4 of FIG. 1 showing it in spur drive mode of operation with continuous web print medium installed therein.

Secured between the tension member 256 and the J-shaped carrier support 38 is a coil spring 266. Force applied to the released tension member 256 by the spring 266 causes it to rotate clockwise about a pivot 268 secured to the carrier support 38. This rotation moves the C-shaped bar 257 into contact with the continuous web print medium 26 as shown in FIG. 7. This contact displaces the print medium 26 even further from the guide path 152. Because the pressure rollers 154 and 162 are no longer urged toward the friction feed roller 156, this displacement established a uniform tension in the print medium 26 from its point of entry into the driving mechanism 30 at one side of the spur drive member 36, around the feed rollers 156, through the printing station 164 to its point of departure from the driving mechanism 30 on the opposite side of the spur drive member 36.

Figure 8:
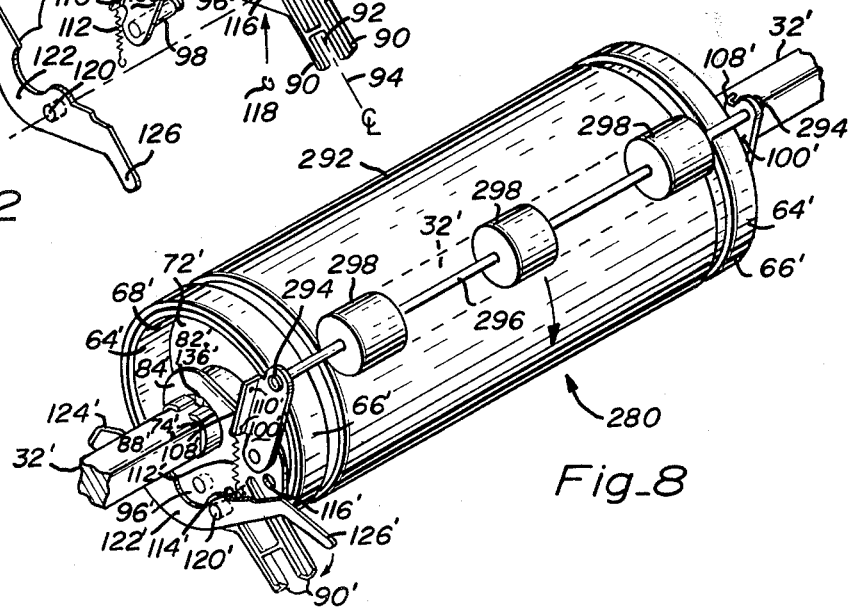
FIG. 8 is a perspective view of an alternative embodiment friction feed assembly in accordance with the present invention.

The print medium driving mechanism 30 of the present invention may employ an alternative embodiment friction feed assembly shown in FIG. 8 and referred to by the general reference character 280. Those elements common to the friction feed assembly 62 carry the same reference numeral distinguished by a prime designation. The friction feed assembly 280 employs two friction feed wheels 64', two yokes 84', two springs 82', two print medium lateral guides 122', two pressure roller arms 100', and two coil springs 112'. The friction feed wheels 64' have an annular groove 282 formed in the surface of the disk-shaped walls 72' furthest from the yoke 84' shown in FIG. 4 and 7. Projecting into the annular groove 282 is a key tab 284. Thus a hollow roller 292, shown in FIG. 8, having annular projections from its terminal end, not shown, adapted to mate with the annular groove 282 and with the tab 284, may be secured about the driveshaft 32 between opposing faces of the wheels 64'. The outer surface of the roller 292 is of the same diameter as the rings 66' and thus establishes a smooth surface spanning most of the distance between them.

Secured between the terminal ends of the pressure roller arms 100' furthest from the yokes 84' by means of screws 294 is a pressure ball 296. Secured about the pressure bail 296 and disposed along its length are three bail pressure rollers 298. As with the friction feed assembly 62, the coil springs 112' of the friction feed assembly 280 maintain the pressure bail 296 and the bail pressure rollers 298 in either of two positions. The first position urges the bail pressure rollers 298 into contact with the hollow roller 292 while the second position places them beneath the roller 292. As with the friction feed assembly 62, positioning the pressure bail 296 and the bail pressure rollers 298 in the second position causes the pressure roller arms 100' to respectively contact the bent arms 126' of the print medium lateral guide 122'. Thus as with the friction feed assembly 62, the angled tabs 124' of the print medium lateral guides 122' are moved out of contact with the carrier support 38 when the pressure bail 296 and the bail pressure rollers 298 are in the second position. While the friction feed assembly 280 may be adjusted laterally along the driveshaft 32, the distance between the friction feed wheels 64' must remain constant because they are clamped between the pressure roller arms 100' and the hollow roller 292. Thus, the friction feed assembly 280 may accept print medium 26 in the form of individual cut sheets having a width "W" not greater than the separation distance between the print medium lateral guides 122'. However, cut sheet print medium 26 having a narrower width may be advanced by the friction feed assembly 280 after, at most, lateral adjustment of the bail pressure rollers 298.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

In the claims:

1. An improved print medium driving mechanism adapted to advance individual cut sheets of print medium and a continuous web of print medium, said continuous web print medium having preformed lateral perforations uniformly spaced along its outer edges, the print medium driving mechanism including at least one rotatably driven spur drive member having a spur wheel with a plurality of spurs positioned equally about and projecting radially from its outer peripheral rim, said spur drive member being adapted for engaging continuous web print medium about its lateral perforations and advancing said print medium uniformly along the path from its entry into the drive mechanism, through a printing station where it may be printed upon and thence of its departure from the drive mechanism wherein the improvement comprises:

a rotatably driven friction feed roller disposed upstream from the printing station and adapted to advance individual cut sheets of print medium into said printing station;

a plurality of pressure rollers individually shorter than and aligned coaxially with the friction feed roller, said pressure rollers being adapted to urge cut sheets of print medium into frictional engagement with said friction feed roller;

pressure means coupled to the pressure rollers and having a first position for maintaining the pressure rollers in a location immediately adjacent to and urged toward the friction feed roller whereby the pressure rollers may clamp cut sheets of print medium into frictional engagement with the feed roller, the pressure means having a second position for maintaining the pressure rollers in a location away from the friction feed roller whereby print medium is freed from frictional engagement with the feed roller;

at least one friction feed assembly including a driven friction feed wheel and a feed wheel pressure roller, the assembly further including force means having a first position for maintaining said feed wheel pressure roller in a location immediately adjacent to and urged towards said friction feed wheel whereby said feed wheel pressure roller may clamp cut sheets of print medium into frictional engagement with said friction feed wheel, said force means having a second position for maintaining said feed wheel pressure roller in a location out of said path along which a continuous web of print medium may be advanced by the spur drive member;

drive means for synchronously rotating the spur drive member, the friction feed roller and said friction feed wheel of the friction feed assembly; and guide means for directing a continuous web or cut sheets of print medium along a path first directed toward the friction feed roller, thence passing between the friction feed roller and the pressure roller, thence passing through said printing station and last directed toward said friction feed wheel of the friction feed assembly.

2. The improved print medium driving mechanism of claim 1 wherein said printing station includes;

an impact printhead secured adjacent to and directed toward said print medium path therethrough, said printhead being further secured within said printing station to be movable along an essentially linear translation path aligned substantially perpendicular to said direction in which the print medium may be advanced through said printing station; and a linear stationary platen disposed immediately adjacent to said print medium path therethrough and on the opposite side of said print medium path from said printhead, said platen being further disposed within said printing station to oppose said printhead and with its length aligned substantially parallel to and along said length of said translation path of said printhead.

3. The improved print medium driving mechanism of claim 1 further comprising means for sensing the presence of print medium within said path established by the guide means.

4. The improved print medium driving mechanism of claims 1 wherein the friction feed assembly further includes a print medium lateral guide, pivotable about an anchor on said friction feed assembly and having a bent arm member projecting transversely through the path along which print medium is directed toward the friction feed roller, said lateral guide being laterally displaceable with said friction feed assembly and adapted to align print medium laterally with the friction feed assembly.

5. The improved print medium driving mechanism of claim 4 wherein said force means contacts said bent arm member of said print medium lateral guide to pivotally retract said print medium lateral guide out of the path along which the print medium is directed towards the friction feed roller when said force means is in said second position, and said print medium lateral guide is freed from contact with said force means and positioned transversely through the path along which the print medium is directed toward the friction feed assembly when said force means is in the first position.

6. The improved print medium driving mechanism of claim 1 wherein the spur drive member and said friction feed assembly are secured about a common drive shaft such that rotation of the spur drive member and said friction feed wheel is synchronous along the full length of the drive shaft and said spur drive member and said friction feed wheel are laterally displaceable along the length of said common drive shaft such that varying width print material can be accommodated.

7. The improved print medium driving mechanism of claim 6 further comprising two spur drive members and two friction feed assemblies, said friction feed assemblies being located on the drive shaft intermediate the spur drive members such that said spur drive members may be laterally displaced to each terminal end of said drive shaft when the friction drive mode is employed.

8. The improved print medium driving mechanism of claim 1 further comprising tension means for establishing tension in the continuous web print medium within said path established by the spur drive member and guide means.

9. The improved print medium driving mechanism of claim 8 wherein the tension means includes a tension bar urged into contact with a continuous web print medium across said width thereof.

10. The improved print medium driving mechanism of claim 9 wherein the pressure means is coupled to said tension bar and is adapted to urge said tension bar out of said path for print medium when pressure means is in said first position, and to allow said tension bar to be urged into contact with a continuous web print medium when in said second position.

11. An improved print medium driving mechanism adapted to advance individual cut sheets of print medium and a continuous web of print medium, said continuous web print medium having uniformly spaced lateral perforations about its outer edges, the print medium driving mechanism including at least one rotatably driven spur drive member having a spur wheel with a plurality of spurs positioned equally about and projecting raidally from its outer peripeheral rim, said spur drive member being adapted for engaging continuous web print medium about its lateral perforations and advancing said print medium uniformly along a path from its entry into the drive mechanism, through a printing station where it may be printed upon and thence to its departure from the drive mechanism wherein the improvement comprises:

a rotatably driven friction feed roller disposed upstream from the printing station and adapted to advance individual cut sheets of print medium into said printing station;

a plurality of pressure rollers, individually shorter than and aligned coaxially with the friction feed roller, said pressure rollers being adapted to urge cut sheets of print medium into frictional engagement with said friction feed roller;

pressure means coupled to the pressure rollers and having a first position for maintaining the pressure rollers in a location immediately adjacent to and urged toward the friction feed roller whereby the pressure rollers may clamp individual cut sheets of print medium into frictional engagment with the feed roller, the pressure means having a second position of maintaining the pressure rollers in a location away from the friction feed roller whereby individual cut sheets of print medium are freed from frictional engagement with the feed roller;

a friction feed assembly including a cylindrical roller and two driven friction feed wheels aligned parallel to, coaxial with and respectively rigidly engaging terminal ends of said cylindrical roller, the friction feed assembly also including a rod shaped pressure bail and a plurality of bail pressure rollers disposed along said bail, said bail being secured within the friction feed assembly with its longitudinal axis aligned substantially parallel to said axis of said cylindrical roller so said bail pressure rollers may all simultaneously be positioned immediately adjacent to said cylindrical roller, the friction feed assembly further including force means having a first position for maintaining said bail pressure rollers in a location immediately adjacent to and urged toward said cylindrical roller whereby said bail pressure rollers may clamp cut sheets of print medium into frictional engagement with said cylindrical roller, said force means having a second position for maintaining said pressure bail and said bail pressure rollers in a location out of said path along which a continuous web of print medium may be advanced by the spur drive member;

drive means for synchronously rotating the spur drive member, the friction feed roller and said friction feed wheels of the friction feed assembly; and guide means for directing continuous web or cut sheets of print medium along a path first directed toward the friction feed roller, thence passing between the friction feed roller and the pressure roller, thence passing through said printing station and lastly directed toward said cylindrical roller of the friction feed assembly.

12. The improved print medium driving mechanism of claim 11 wherein the spur drive member, said cylindrical roller and said friction feed wheels are secured about and laterally displacable relative to each other along the length of a common drive shaft such that rotation of the spur drive member, said roller and said friction feed wheel are synchronous.

13. The improved print medium driving mechanism of claim 11 wherein the friction feed assembly further includes a print medium lateral guide, pivotable about an anchor on said friction feed assembly and having a bent arm member projecting transversely through the path along which the print medium is directed toward the friction feed roller, said lateral guide being laterally displaceable with said friction feed assembly and adapted to align the print medium laterally with the friction feed assembly.

14. The improved print medium driving mechanism of claim 13 wherein said force means contacts said bent arm member of said print medium lateral guide to pivotally retract said print medium lateral guide out of the path along which the print medium is directed towards the friction feed roller when said force means is in said second position, and said print medium lateral guide is freed from contact with said force means and positioned transversely through the path along which the print medium is directed toward the friction feed assembly when said force means is in the first position.

15. The improved print medium driving mechanism of claim 11 wherein said printing station includes;

an impact printhead secured adjacent to and directed toward said print medium path therethrough, said printhead being further secured within said printing station to be movable along an essentially linear translation path aligned substantially perpendicular to said direction in which the print medium may be advanced through said printing station; and a linear stationary platen disposed immediately adjacent to said print medium path therethrough and on the opposite side of said print medium path from said printhead, said platen being further disposed within said printing station to oppose said printhead and with its length aligned substantially parallel to and along said length of said translation path of said printhead.

16. The improved print medium driving mechanism of claim 11 further comprising means for sensing the presence of print medium within said path established by the guide means.

17. The improved print medium driving mechanism of claim 11 further comprising tension means for establishing tension in the continuous web print medium with said path established by the spur drive member and guide means.

18. The improved print medium driving mechanism of claim 17 wherein the tension means includes a tension bar urged into contact with a continuous web print medium across said width thereof.

19. The improved print medium driving mechanism of claim 18 wherein the pressure means is coupled to said tension bar and is adapted to urge said tension bar out of said path for the print medium when the pressure means is in said first position, and to allow said tension bar to be urged into contact with a continuous web print medium when the pressure means is in said second position.

* * * * *